US005255810A

United States Patent [19]

Hosford

[11] Patent Number: 5,255,810

[45] Date of Patent: Oct. 26, 1993

[54] CLOSURE HATCH ASSEMBLY FOR AN ACCESS PORT IN A HIGHWAY UTILITY POLE

[75] Inventor: Gregory S. Hosford, Columbia, S.C.

[73] Assignee: Shakespeare Company, Newberry, S.C.

[21] Appl. No.: 980,922

[22] Filed: Nov. 24, 1992

[51] Int. Cl.[5] ..... B65D 45/00

[52] U.S. Cl. ..... 220/243; 220/251

[58] Field of Search ..... 220/243, 251, 314; 174/66; 138/89, 90, 92; 292/260; 411/427, 432

[56] References Cited

U.S. PATENT DOCUMENTS

| | | | |
|---|---|---|---|
| 2,875,804 | 3/1959 | Flora | 411/427 |
| 4,575,295 | 3/1986 | Rebentisch | 411/85 |
| 4,850,633 | 7/1989 | Emery | 296/39.2 |
| 4,895,484 | 1/1990 | Wilcox | 411/85 |
| 4,914,258 | 4/1990 | Jackson | 174/45 R |

*Primary Examiner*—Allan N. Shoap
*Assistant Examiner*—Nova Stucker
*Attorney, Agent, or Firm*—Renner, Kenner, Greive, Bobak, Taylor & Weber

[57] ABSTRACT

This disclosure relates to a closure hatch assembly for the access port of a utility pole of the type particularly suited for supporting an electrical device and housing the electrical cables required to provide power to the electrical device. The closure hatch assembly has a hatch plate made of a composite, non-conductive material and is of such dimensions as to close the access port. A lip extends outwardly from the periphery of the closure plate to engage the exterior surface of the utility pole circumjacent the access port. A groove, or channel, is provided on the hatch plate to receive a hollow bracket member. The hollow bracket member is also made of a non-conductive composite material. When received within the channel, the bracket member has sufficient length to extend beyond the hatch plate to engage the interior surface of the utility pole. The bracket member may be secured to the hatch plate and maintained in abutment with the interior surface of the utility pole by a metal fastener which is threaded into a sheet metal nut that is supported from the bracket member. The bracket member is configured such, and is embraced by the channel such, that no wires can engage the threaded metallic screw or the sheet metal nut.

6 Claims, 5 Drawing Sheets

CLOSURE HATCH ASSEMBLY FOR AN ACCESS PORT IN A HIGHWAY UTILITY POLE

TECHNICAL FIELD

The present invention relates generally to highway utility poles in the nature of those employed to support lights, signs, traffic signals and the like, alongside roads and highways. More particularly, the present invention relates to closure assemblies for the electrical service access provided in highway utility poles. Specifically, the present invention relates to closure assemblies that enhance safety by tending to preclude electrical conductivity therethrough, even though they may be directly engaged by a bare wire located interiorly of the utility pole.

BACKGROUND OF THE INVENTION

Originally, highway utility poles were wood, steel or concrete, but such poles provided rigid resistance to impact from vehicles. As a result, when a vehicle struck such a utility pole the occupants of the vehicle were commonly subjected to extremely severe, or even fatal, injury. This result led to the development of highway utility pole structures which greatly reduced the high incidence of such injuries. In fact, utility poles utilized on federally funded highway projects must now meet rigid breakaway performance criteria. The present required breakaway performance criteria are set forth in the American Association of State Highway Transportation Officials Publication entitled "Standard Specifications for Structural Supports for Highway Signs, Luminaries and Traffic Signals 1985."

To meet these requirements, highway utility poles have been constructed of lightweight materials such as aluminum and fiberglass. The latter material has proven to be particularly desirable not only in meeting the breakaway performance criteria, but also because such utility poles are not electrically conductive. Thus, when fiberglass poles are broken the pole itself can not serve as a conductor. This is a definite advantage attributable to the fiberglass utility pole.

Electrical service is frequently provided to utility poles by underground lines, and the hollow interior of even the non-conductive utility poles serves as the path along which the electrical service lines may extend to provide the desired electrical power to lights, or the like, mounted at the top of the pole, or to whatever height required. An access port is typically provided in the utility pole, normally at a height which can be reached by a worker standing on the ground or on a relatively short ladder. Such access ports are each provided with a closure hatch that have heretofore employed a metal screw and metal bracket, or bar, to secure the closure plate in position over, or within, the access port. The wires extending within the hollow utility pole can contact the bracket and/or the screw. If the insulation on one of the wires within the pole is abraded, or if a bare wire otherwise comes in contact with the bracket or screw, anyone touching the screw either directly or with a conductive screw driver can be exposed to electrical shock. Inasmuch as many currently installed utility poles are manufactured with non-conductive materials, the only electrical path to a person removing the cover is through the screw and bracket. This can virtually assure that the person removing the closure hatch will be subjected to an electrical shock. When a conductive pole is used, an electrical circuit is completed between the screw and the pole through the bracket employed by the closure hatch assembly.

SUMMARY OF THE INVENTION

It is, therefore, a primary object of the present invention to provide an improved closure hatch assembly for electrical service access ports of the type provided in highway utility poles.

It is another object of the present invention to provide an improved closure hatch assembly, as above, for an electrical utility pole assembly having internal electrical wires wherein the closure hatch assembly incorporates a hollow non-conductive bracket member disposed within the pole and having a hollow interior dimensioned to contain a metal screw member out of contact with the wires.

It is a further object of the present invention to provide an improved closure hatch assembly, as above, that incorporates an electrically non-conductive composite cover, an electrically non-conductive composite hollow bracket, a sheet metal fastener secured to the hollow bracket and a metal screw extending through the cover and threadably engaging the fastener to secure the cover to the bracket, with the screw maintained within the hollow bracket out of potential contact with wires received interiorly of the pole.

It is still another object of the present invention to provide an improved access port closure hatch assembly, as above, wherein the hatch and bracket are constructed to prevent the wires from contacting the screw between the bracket and the cover.

These and other objects of the invention, as well as the advantages thereof over existing and prior art forms, which will be apparent in view of the following detailed specification, are accomplished by means hereinafter described and claimed.

In general, the present invention provides a composite closure hatch, or plate, which is secured to an electrical utility pole by a metal screw and sheet metal nut. The nut is positioned interiorly of a composite bracket, the hollow interior of which has sufficient internal space to prevent the end of the screw from being able to contact the electrical wires housed in the pole. The internal surface of the closure plate is provided with a recess that complementarily receives the bracket in order to prevent the wires housed within the utility pole from inadvertently entering between the bracket and the closure plate, or hatch.

One exemplary embodiment of an access port closure hatch assembly embodying the concepts of the present invention, and particularly adapted for use with an electrical utility pole, is shown by way of example in the accompanying drawings and is described in detail without attempting to show all of the various forms and modifications in which the invention might be embodied; the invention being measured by the appended claims and not by the details of the specification.

The forgoing objects and advantages will be more apparent from the following detailed description of an exemplary embodiment depicted in the drawings.

DESCRIPTION OF AN EXEMPLARY EMBODIMENT

Figure 1:
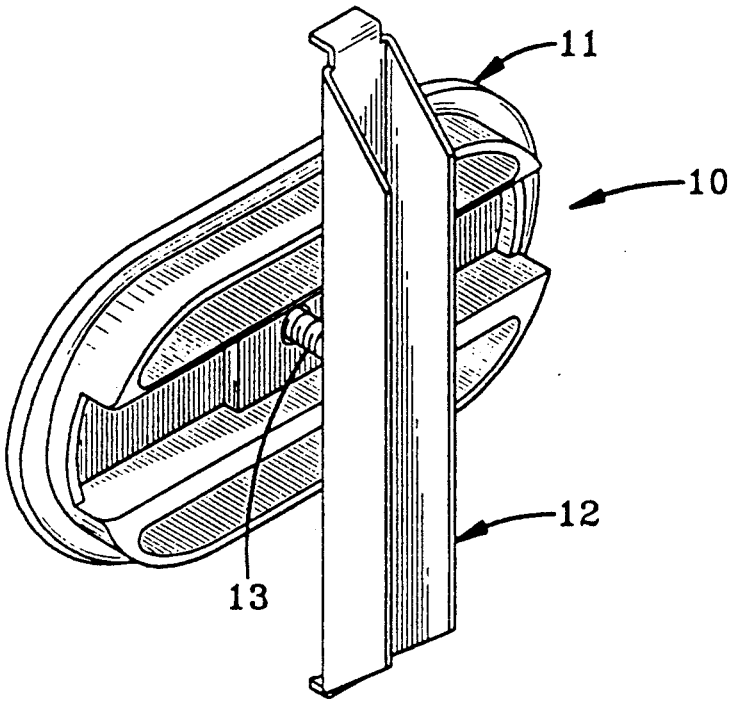
FIG-1 PRIOR ART
FIG. 1 is a perspective view of a prior art cover and bracket assembly.
Figure 2:
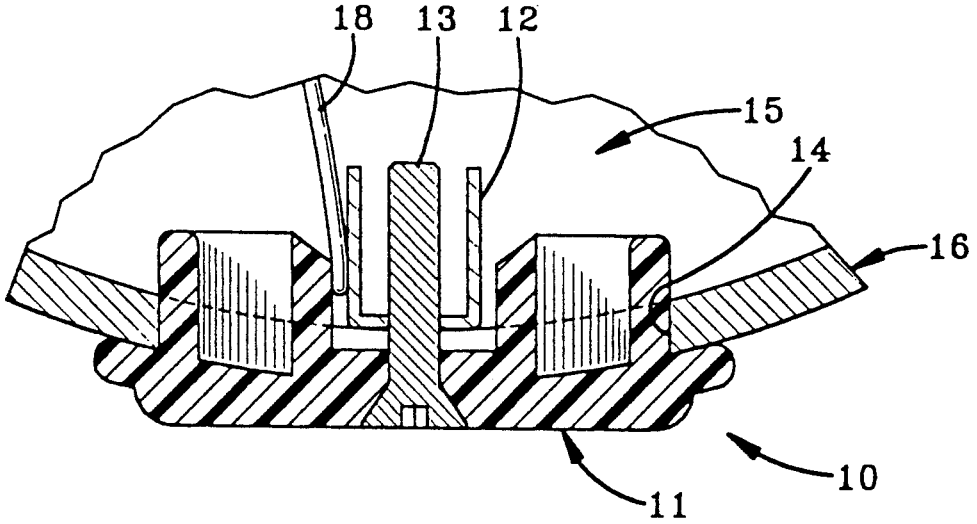
FIG-2 PRIOR ART
FIG. 2 is a cross sectional view of the prior art cover and bracket assembly depicted in FIG. 1, said assembly being depicted as closing an access port in a highway utility pole.
Figure 3:
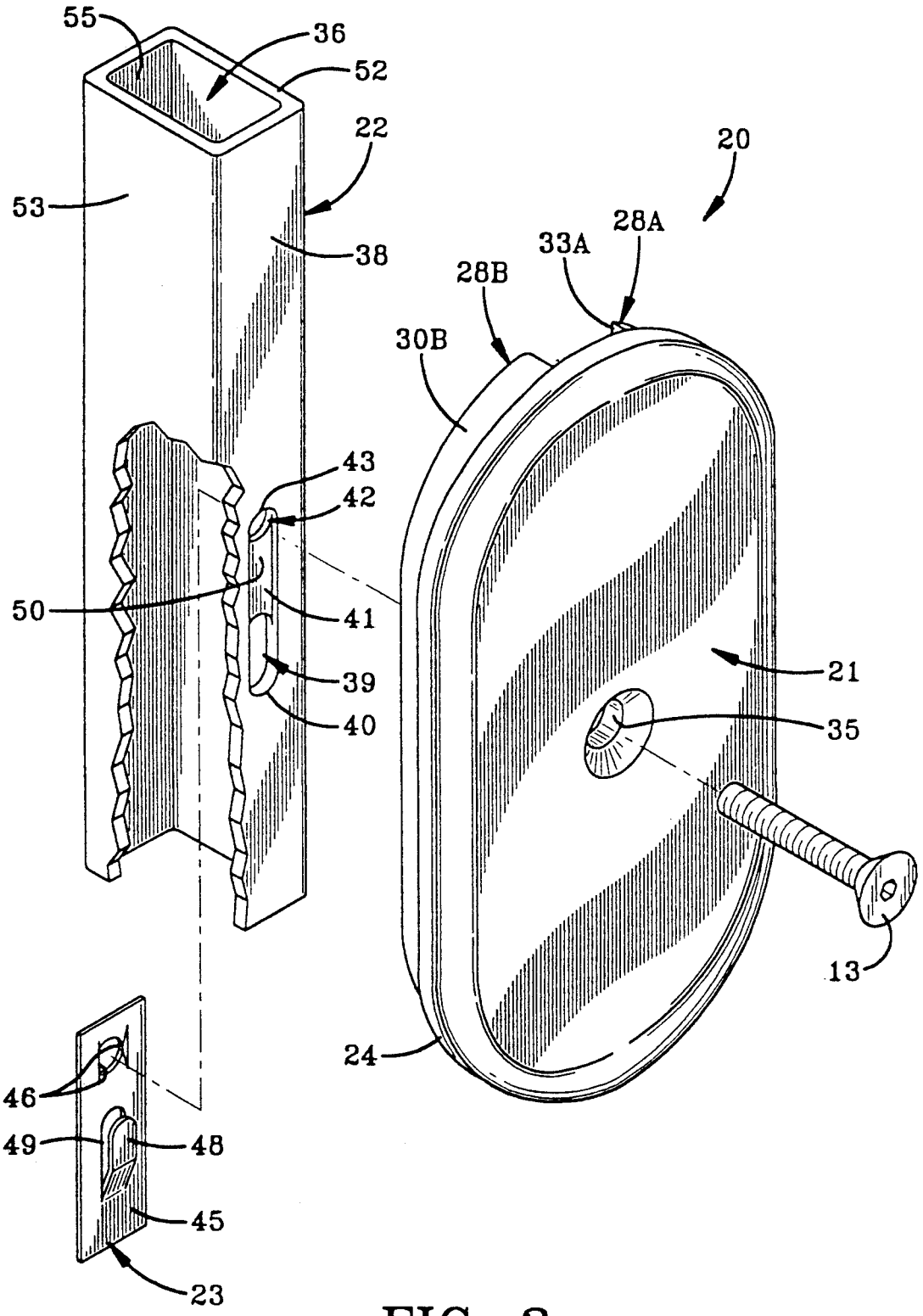
FIG. 3 is an exploded perspective view of a closure hatch assembly embodying the concepts of the present invention.

The prior art closure assembly 10, as shown in FIGS. 1 and 2, includes a non-conductive closure plate 11, a mounting bracket 12 and a fastening screw 13. The assembly 10 is used to close an access port 14 by which authorized personnel can gain ready access to the hollow interior 15 of a highway utility pole 16. Both the bracket 12 and the screw 13 are typically made with an electrical conductive material such as steel. The bracket 12 and screw 13, as seen in FIG. 2, can be exposed to an electrical wire 18 housed within the hollow interior 15 of the pole 16.

In the situation where the insulation on the wire 18 may have been abraded sufficiently to expose the bare wire for contact with the bracket 12 or screw 13 a repair person may be subjected to an electrical shock when loosening the screw 13 to remove the cover assembly 10. It should be appreciated that if the pole itself were also electrically conductive, because the bracket 12 contacts the pole 16, any bare wire touching the pole 16 would close an electrical circuit between the screw 13 and the pole 16.

A closure hatch assembly 20 embodying the concepts of the present invention, and shown in FIGS. 3–6, obviates the potential for electrical shock, even though a conductive mounting screw 13 of the type described in conjunction with the prior art would be used. The improved closure hatch assembly 20 utilizes a non-conductive hatch plate 21, a non-conductive bracket member 22, a threaded male fastener, or screw, 13 and a female sheet metal nut 23.

The hatch plate 21 may be constructed of fiberglass or other commercially available composite plastic material that is electrically non-conductive. The hatch plate 21 may be constructed of the same non-conductive material as the currently available non-conductive closure plates 11 shown and described in conjunction with FIGS. 1 and 2. Moreover, even the currently available closure plates 11 may be employed in the improved assembly 20. This approach can save considerable resources by allowing existing assemblies 10 to be readily modified to the accomplish the objects of the present invention.

Figure 4:
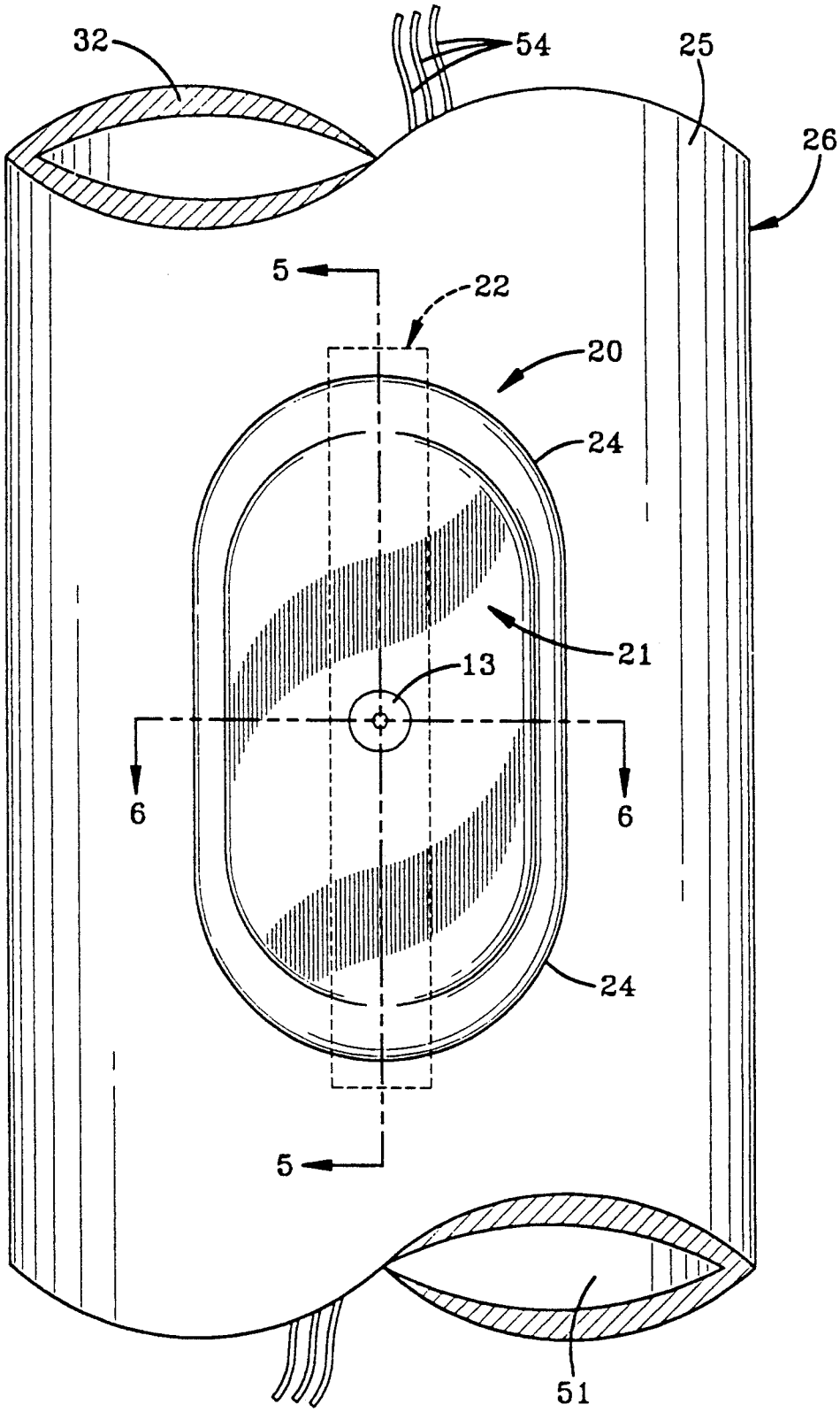
FIG. 4 is an elevational view of the closure hatch assembly depicted in FIG. 3 installed to close an access port in a utility pole.
Figure 5:
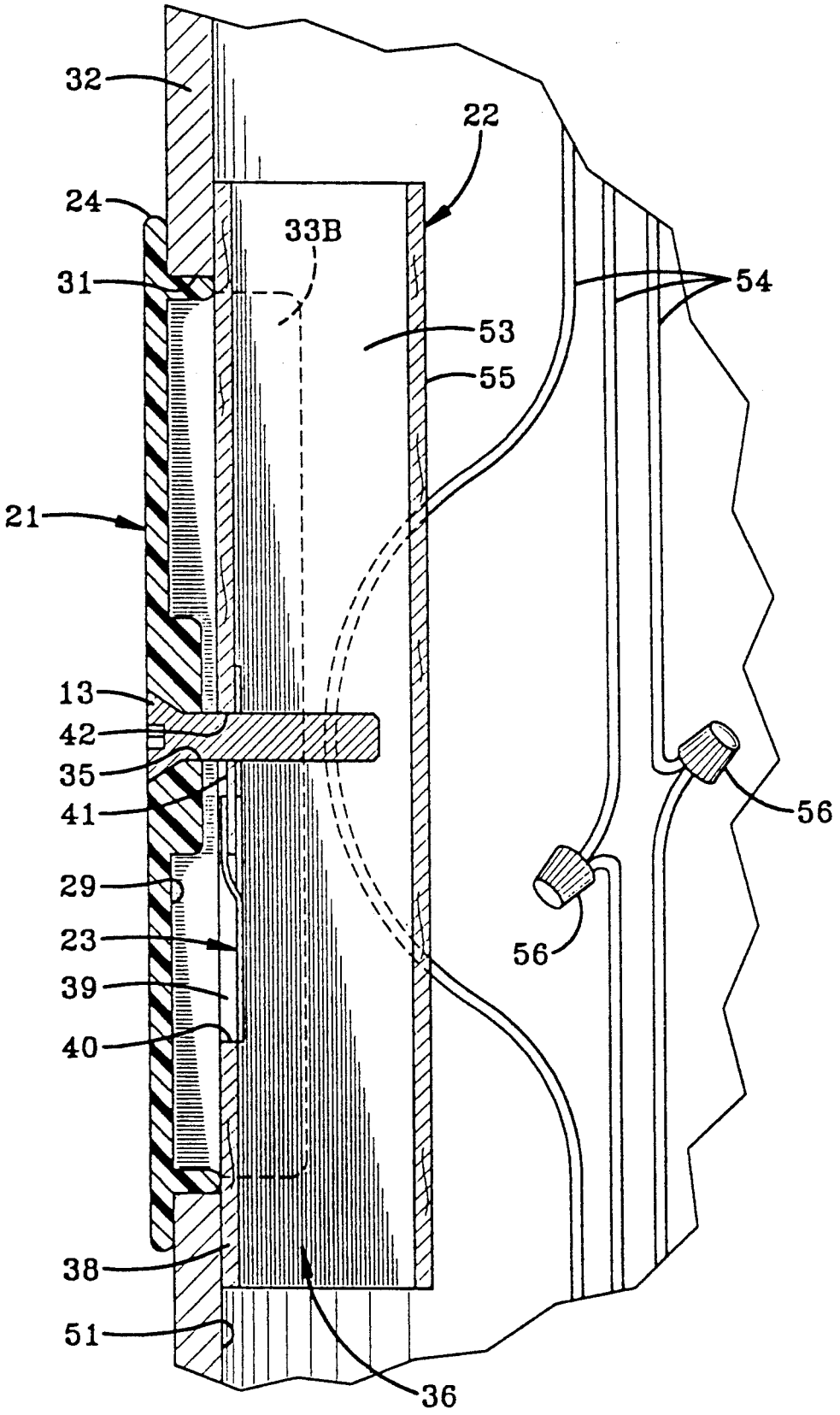
FIG. 5 is a longitudinal oriented sectional view taken substantially along line 5—5 of FIG. 4; and, FIG. 6 is a transverse sectional view taken substantially along line 6—6 of FIG. 4.
Figure 6:
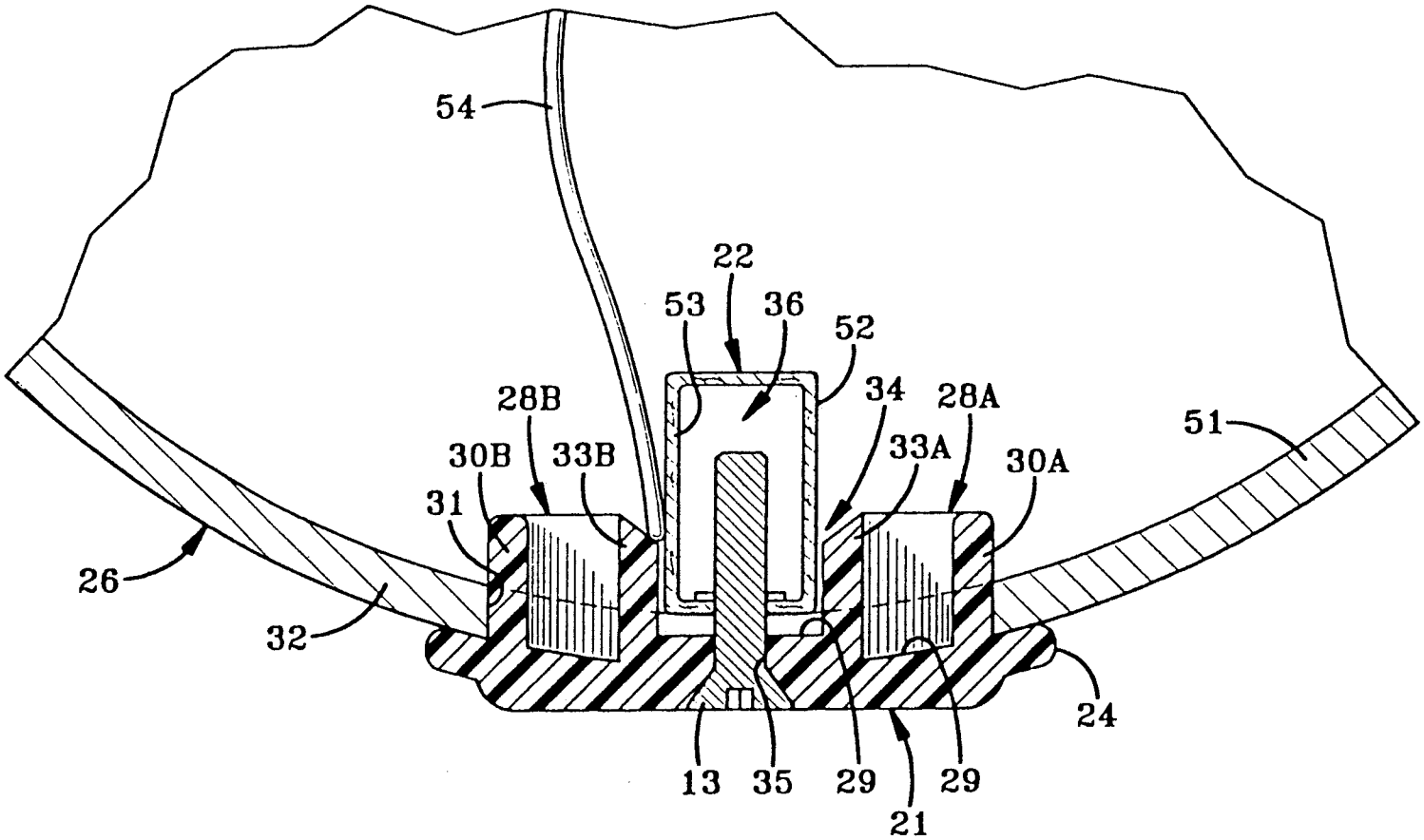

The hatch plate 21 is generally oval, or perhaps more accurately, has a racetrack shaped outer periphery, as can be seen in FIG. 4. A lip 24 extends outwardly along the entire outer periphery of the hatch plate 21 and defines the racetrack shaped outline. In addition, the lip 24 is transversely curved to engage the cylindrical outer surface 25 of the utility pole 26 (FIG. 6). A pair of laterally spaced protuberances 28A and 28B extend outwardly from the reverse face 29 of the hatch plate 21. The laterally outer walls 30 of each protuberance 28 follow the generally elliptical, or racetrack configuration, of the lip 24 and are offset from the periphery of the lip 24 to cooperate therewith to define the aligning, or locating, means by which to position the hatch plate 21 properly with respect to a corresponding elliptical access aperture 31 provided in the wall 32 of the highway utility pole 26.

As previewed in the previous paragraph, and as will appear in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation employed for general designation of that structural member, component or arrangement. Thus, there are at least two protuberances which are generally identified by the numeral 28, but the specific, individual protuberances are, therefore, identified as 28A and 28B in the specification and on the drawings. This same suffix convention shall be employed throughout the specification.

The laterally spaced, opposing walls 33A and 33B of the respective protuberances 28A and 28B delineate a groove, or bracket receiving channel, 34 therebetween. The bracket member 22 is receivable within the groove, or channel, 34 and may be secured therein by a fastener in the nature of the screw 13 that extends through a bore 35 which penetrates the hatch plate 21 medially between the protuberances 28. The bracket member 22 may also preferably be made of fiberglass. Here, too, most of the commercially available hardened reinforced plastic composites will perform satisfactorily.

The bracket member 22 is shown as being substantially rectangular with a hollow cavity 36 that extends the full longitudinal extent of the bracket member 22. One wall 38 of the bracket member 22 is pierced by a slot 39 that connects with one end 40 of a recess 41 which is formed in the outer surface of the wall 38. An aperture 42 penetrates the wall 38 from the other end 43 of the recess 41.

The sheet metal nut 23 has a body portion 45 which presents opposed, thread engaging, spring tangs 46. An attachment tab 48 is formed from the body portion 45 by striking and deforming a portion of the metal forming the body portion 45 outwardly of the main plane of the body portion 45 to provide a space 49 between the body portion 45 and the tab 48. The sheet metal nut 23 is located within the cavity 36 that extends longitudinally of the bracket member 22 and is secured in position by the tab 48. Specifically, the tab 48 extends through the slot 39 to be received within the recess 41. The space 49 is slightly smaller than the thickness of the wall 38, even when measured to the offset base surface 50 of the recess 41. The tab 48 and body portion 45 of the sheet metal fastener 23 provide a spring action that maintains the fastener 23 in position on the wall 38 of the bracket member 22. When the fastener 23 is properly located on the bracket member 22, the opposed, thread engaging spring tangs 46 will be aligned with the bore 35 through the hatch plate 21. This can be visually observed prior to connection of the hatch plate 21 to the bracket member 22.

To attach the closure hatch assembly 20 to the pole 26, the hatch plate 21 is loosely secured to the bracket member 22 by the screw 13. That is, the screw 13 is threaded into the sheet metal nut 23 with only two or three turns of the threads. This loose connection between the hatch plate 21 and the bracket member 22 permits the bracket member 22 to be "button-holed" through the access aperture 31 and then be longitudinally displaced so that the bracket member 22 will span the access aperture 31 to engage the interior surface 51 of the pole 26 on opposite side of the aperture 31 without interference from the hatch plate 21. With the bracket member 22 and the groove, or channel, 34 in the hatch plate 21 disposed in alignment, the screw 13 is further tightened into the sheet metal nut 23, thereby securing the protuberances 28 within the access aperture 31 and simultaneously securing the bracket member 22 within the groove 34. The resulting pressure applied by the lip 24 to the cylindrical outer surface 25 of the utility pole 26 in opposition to the opposed pressure applied by the bracket member 22 to the cylindrical interior surface 51 of the utility pole 26 holds the closure hatch assembly 20 securely in position to close the access aperture 31.

As best seen in FIG. 6, the opposed walls 33A and 33B on the spaced, parallel protuberances 28A and 28B—which define the side walls of the groove, or channel, 34—are preferably disposed to lie in close proximity to the side walls 52 and 53 of the bracket member 22 when the closure hatch assembly 20 is secured on the utility pole 26. This complementary relationship of the mounting bracket 22 within the groove 34 is employed to prevent any wires, as at 54, within the utility pole 26 from coming into contact with any portion of the screw 13 which may extend between the hatch plate 21 and the wall 38 of the bracket member 22. This is particularly important in installations where the thickness of the pole wall 32 is almost equal to the height of the protuberances 28. When this geometric relation occurs, the maximum length of the screw 13 will be exposed between the hatch plate 21 and the wall 38. However, the proximity of the opposed walls 33A and 33B as they embrace the side walls 52 and 53 of the bracket member 22 prevents the wires 54 from contacting the screw 13.

The hollow cavity 36 must have a dimension "D" that is greater than that length "L" of the screw 13 that extends beyond the sheet metal nut 23 when the assembly 20 is secured to the utility pole 26. This geometric relation prevents the screw 13 from protruding through the back wall 55 of the bracket member 22. This further precludes contact between the metal screw 13 and any wires 54.

Utility poles 26 can be quite tall and can support massive, and heavy, electrical structures at the upper its end. A typical example would be the lighting device suspended from an arm that is cantilevered outwardly from the pole 26. When the utility pole 26 is subjected to wind, rain and snow it may sway sufficiently that the wires 54 will move within the hollow pole 26. Should the wires 54 be even partially pinched between the bracket member 22 and the protuberances 28, stretching forces applied to the wire 54 can abrade the insulation on the wire 54 leaving a portion of the bare wire exposed. In another scenario, if a wire 54 comprises two lengths that are joined by a wire nut 56, the swaying movement of the pole might cause the wire nut 56 to be loosened, thereby exposing the bare ends of the wire 54. In either situation, the bare portions of the wires cannot, with the improved arrangement of the present invention, contact the metal screw 13 or the sheet metal nut 23. Thus, service personnel are protected from inadvertently being exposed to electrical shock. Also, because the bracket member 22 is non-conductive, an electric circuit cannot be completed through the screw 13 even when a metal pole 26 is employed. The present invention will, therefore, operate equally well with existing poles constructed of conductive materials such as steel or aluminum.

From the above description, those skilled in the art will recognize that the invention herein disclosed will prevent service personnel from being exposed to electrical shock from bare wires 54 within the pole 26. The composite bracket member 22 and the hatch plate 21 provide electrical insulation from any bare wires in the pole 26 such that metal screws 13 and sheet metal nuts 23 can be used to secure the closure hatch assembly 20 to the pole 26. This combination of fastening means also provides the closure assembly 20 with highly suitable strength and holding capability.

The foregoing description of an exemplary embodiment of the invention has been presented for the purposes of illustration and description. It is not intended to be exhaustive or to limit the invention to the precise form disclosed. Obvious modifications, or variations, are possible in light of the above teachings. The embodiment was chosen and described to provide the best illustration of the principles of the invention and its practical application in order to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

As should now be apparent, the present invention not only teaches that a closure hatch assembly—for the access port of a utility pole—embodying the concepts of the present invention precludes the potential for inadvertent electrical shocks to installation and/or maintenance personnel but also accomplishes the other objects of the invention.

I claim:

1. A hatch assembly for closing an access port in a housing for electrical wires, said hatch assembly comprising:

a non-conductive hatch plate having a reverse face;

laterally spaced, longitudinally oriented, protuberance means extending outwardly from said reverse face on said hatch plate;

opposed walls on said protuberance means defining a channel therebetween;

a non-conductive, hollow bracket member receivable within said channel to extend longitudinally beyond said hatch plate;

nut means supported within said hollow bracket member;

a threaded fastener extending through said hatch plate to be selectively tightened within said nut means to secure said bracket member within said channel and thereby restrict access to said fastener.

2. A hatch assembly, as set forth in claim 1, wherein:

said bracket member is receivable within said channel in sufficiently close proximity with said opposed walls defining said channel to prevent the passage of a wire therebetween.

3. A hatch assembly, as set forth in claim 1, wherein:

means are provided to secure said nut means on said bracket member at a predetermined location to align said nut means with said threaded fastener means.

4. A hatch assembly, as set forth in claim 3, wherein;

said bracket member has a wall disposed adjacent said hatch plate;

a recess in said wall;

said nut means has a body portion and an attachment tab extending outwardly from, and longitudinally of, said body portion to be received in said recess to maintain said nut means aligned with said threaded fastener means.

5. A hatch assembly, as set forth in claim 3, wherein:

said channel complementarily embraces said bracket received therein with sufficiently close proximity to prevent wires within the pole from entering between said channel and said bracket member.

6. A hatch assembly, as set forth in claim 5, wherein:

said threaded fastener has a predetermined length; and, said hollow bracket member has an interior dimension sufficient to receive said threaded fastener without exposure to said wires.

* * * * *

UNITED STATES PATENT AND TRADEMARK OFFICE

CERTIFICATE OF CORRECTION

PATENT NO. : 5,255,810

DATED : October 26, 1993

INVENTOR(S) : Gregory S. Hosford

It is certified that error appears in the above-indentified patent and that said Letters Patent is hereby corrected as shown below:

Column 6, line 54 (Claim 1), delete the word "hollow" and substitute therefor -- tubular --; after the word "member" insert the phrase -- having a substantially rectangular cross-section --; and, line 57, delete the word "hollow".

Column 8, line 11 (Claim 6), delete the word "hollow".

Signed and Sealed this

Eighteenth Day of February, 1997

Bruce Lehman

*Attest:*

BRUCE LEHMAN

*Attesting Officer*

*Commissioner of Patents and Trademarks*